US006033046A

United States Patent [19]

Lambright

[11] Patent Number: 6,033,046

[45] Date of Patent: Mar. 7, 2000

[54] CABINET ASSEMBLY

[75] Inventor: Michael D. Lambright, Archbold, Ohio

[73] Assignee: Sauder Woodworking Co., Archbold, Ohio

[21] Appl. No.: 09/033,818

[22] Filed: Mar. 3, 1998

[51] Int. Cl.[7] ..... E06B 1/00

[52] U.S. Cl. ..... 312/312.5; 312/295; 312/310

[58] Field of Search ..... 312/312.5, 324, 312/329, 326, 291, 283, 197, 26, 30, 295, 310, 325

[56] References Cited

U.S. PATENT DOCUMENTS

| | | | |
|---|---|---|---|
| 184,375 | 11/1876 | Hansen . | |
| 241,123 | 5/1881 | Danner | 312/329 X |
| 264,749 | 9/1882 | Potts | 312/197 X |
| 654,922 | 7/1900 | Schipkowsky . | |
| 1,227,799 | 5/1917 | Kaub | 312/310 X |
| 1,507,760 | 9/1924 | Sutherland . | |
| 1,543,980 | 6/1925 | Blood . | |
| 1,559,705 | 11/1925 | Jackson . | |
| 1,798,800 | 3/1931 | Macknight . | |
| 1,948,703 | 2/1934 | Fanarjian . | |
| 2,597,782 | 5/1952 | Ferm | 312/329 X |
| 3,078,133 | 2/1963 | Schauer . | |
| 3,089,745 | 5/1963 | Postula et al. . | |
| 3,241,900 | 3/1966 | Hamilton et al. . | |
| 3,510,187 | 5/1970 | Schreyer . | |
| 3,862,785 | 1/1975 | Scheerhorn et al. . | |
| 4,272,136 | 6/1981 | Sengua . | |
| 4,502,742 | 3/1985 | Neff . | |
| 4,755,009 | 7/1988 | Price et al. . | |
| 5,121,974 | 6/1992 | Monson . | |
| 5,145,245 | 9/1992 | Fierthaler . | |
| 5,147,122 | 9/1992 | Short . | |
| 5,158,344 | 10/1992 | Thurston | 312/329 X |
| 5,287,815 | 2/1994 | Gross . | |
| 5,558,418 | 9/1996 | Lambright et al. . | |

FOREIGN PATENT DOCUMENTS

| | | | |
|---|---|---|---|
| 332963 | 11/1903 | France . | |
| 75777 | 11/1893 | Germany . | |
| 108670 | 2/1925 | Sweden . | |
| 222358 | 10/1924 | United Kingdom | 312/326 |

*Primary Examiner*—Peter M. Cuomo
*Assistant Examiner*—James O. Hansen
*Attorney, Agent, or Firm*—Emch, Schaffer, Schaub & Porcello Co., L.P.A.

[57] ABSTRACT

A cabinet assembly having a plurality of door assemblies including storage shelves. The door assemblies are pivotally mounted in the cabinet assembly to provide access to the shelves. The door assemblies maximize storage space within the cabinet assembly.

2 Claims, 10 Drawing Sheets

CABINET ASSEMBLY

BACKGROUND OF THE INVENTION

The present invention relates generally to a door assembly for a corner cabinet. More specifically, the invention is directed to a door assembly for a corner cabinet that is pivotly mounted to the corner cabinet to provide superior storage within the corner cabinet.

Corner cabinets are known in the art. It has been found that these prior art corner cabinets do not provide sufficient storage space for such items as video cassette tapes, compact discs and the like. Therefore, there is a need for a door assembly for a corner cabinet that provides sufficient storage space within the cabinet. The present invention satisfies this need.

SUMMARY OF THE INVENTION

The present invention is directed to a door assembly for a corner cabinet having a top and a base. In a first embodiment, the door assembly includes at least one first door member extending between the top and the base. At least one second door member extends between the top and the base. The second door member has a first edge portion, a second edge portion and a center portion positioned between the first and second edge portions. The first edge portion is attached to the first door member at a predetermined angle. The first and second door members are moveable between closed and open positions. The assembly includes at least one hinge device connected to either the top or the base of the cabinet and the center portion of the second door member to allow for movement of the first and second door members between the closed and open positions.

In a second embodiment, the door assembly includes at least one first door member extending between the top and the base of the cabinet. The first door member has a first edge portion, a second edge portion and a center portion positioned between the first and second edge portions. At least one second door member extends between the top and the base. The second door member is attached to the first edge portion of the first door member at a predetermined angle. The first and second door members are moveable between closed and open positions. The assembly further includes at least one hinge device connected to either the top or the base of the cabinet and the center portion of the first door member to allow for movement of the first and second door members between the closed and open positions.

In a third embodiment, the door assembly includes at least one first door member extending between the top and the base of the corner cabinet. The first door member has a first edge and a second edge. At least one second door member extends between the top and the base. The second door member has a first edge portion and a second edge portion. The first edge portion of the second member is attached to the second edge of the first door member at a predetermined angle to form a joint. The assembly further includes at least one hinge device connected to either the top or the base of the cabinet and the joint to allow for movement of the first and second door members between the closed and open positions.

It is the primary object of the present invention to provide a door assembly for a corner cabinet that allows for superior storage space within the cabinet.

Other objects and advantages of the present invention will become apparent to those skilled in the art upon a review of the following detailed description of the preferred embodiments and the accompanying drawings.

DETAILED DESCRIPTION OF THE PREFERRED EMBODIMENTS

Figure 1:
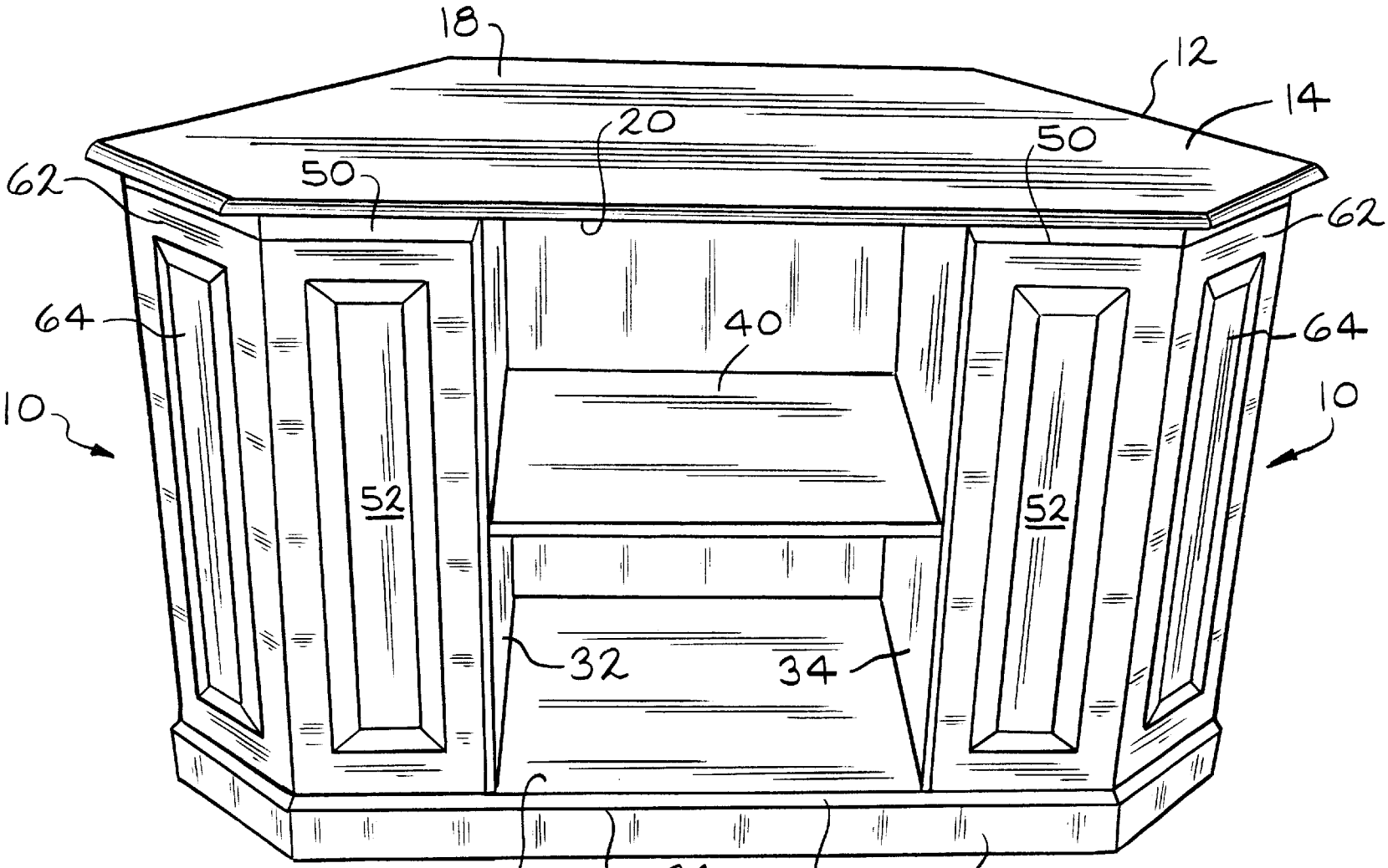
FIG. 1 is a front perspective view of a corner cabinet including a do a according to the present invention in which the door assembly is in a closed position.

The preferred embodiments and best mode of the present invention will now be described in detail with reference being made to the drawings. The first embodiment door assembly for a corner cabinet according to the present invention is indicated generally in the drawings by the reference number "10".

Referring to FIGS. 1–4, the door assembly 10 is shown with a corner cabinet 12. The corner cabinet 12 has a top 14 and a base 16. The top 14 includes an upper surface 18 and a lower surface 20. The base includes an upper surface 22 and a lower surface 24. A skirt 26 extends along the lower surface 24 of the base 16. The cabinet 12 includes a first side wall 28 and a second side wall 30. The cabinet 12 further includes a first compartment wall 32 and a second compartment wall 34. Two shelves 36 and 38 extend between the first side wall 28 and the first compartment wall 32. One shelf 40 extends between the first and second compartment walls 32 and 34. Two shelves 42 and 44 extend between the second compartment wall 34 and the second side wall 30. As shown FIG. 3, the cabinet 12 includes first and second glass doors 46 and 48 movably mounted on the first and second compartment walls 32 and 34, respectively.

Figure 2:
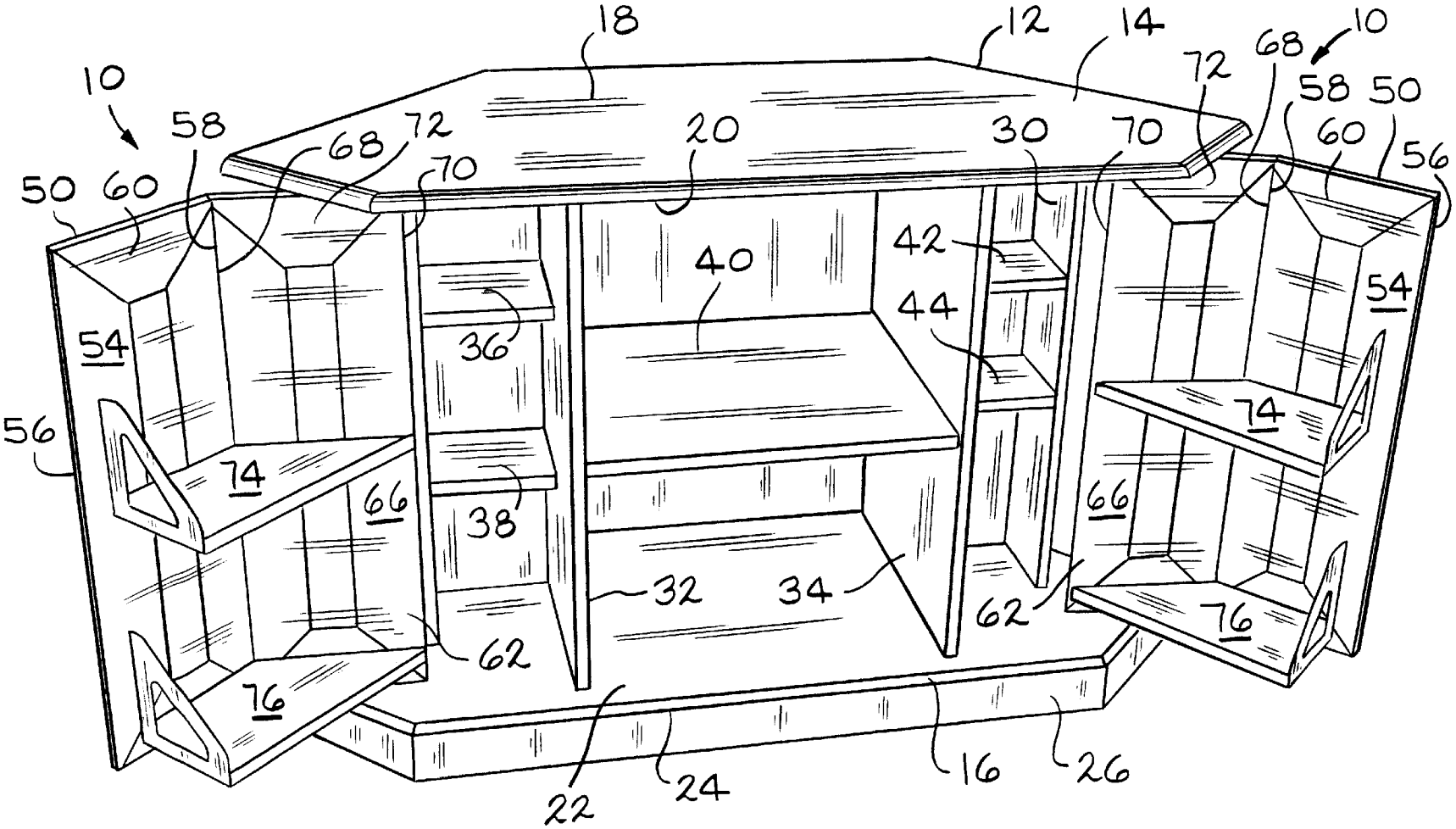
FIG. 2 is a view similar to the view of FIG. 1 showing the door assembly in an open position.
Figure 3:
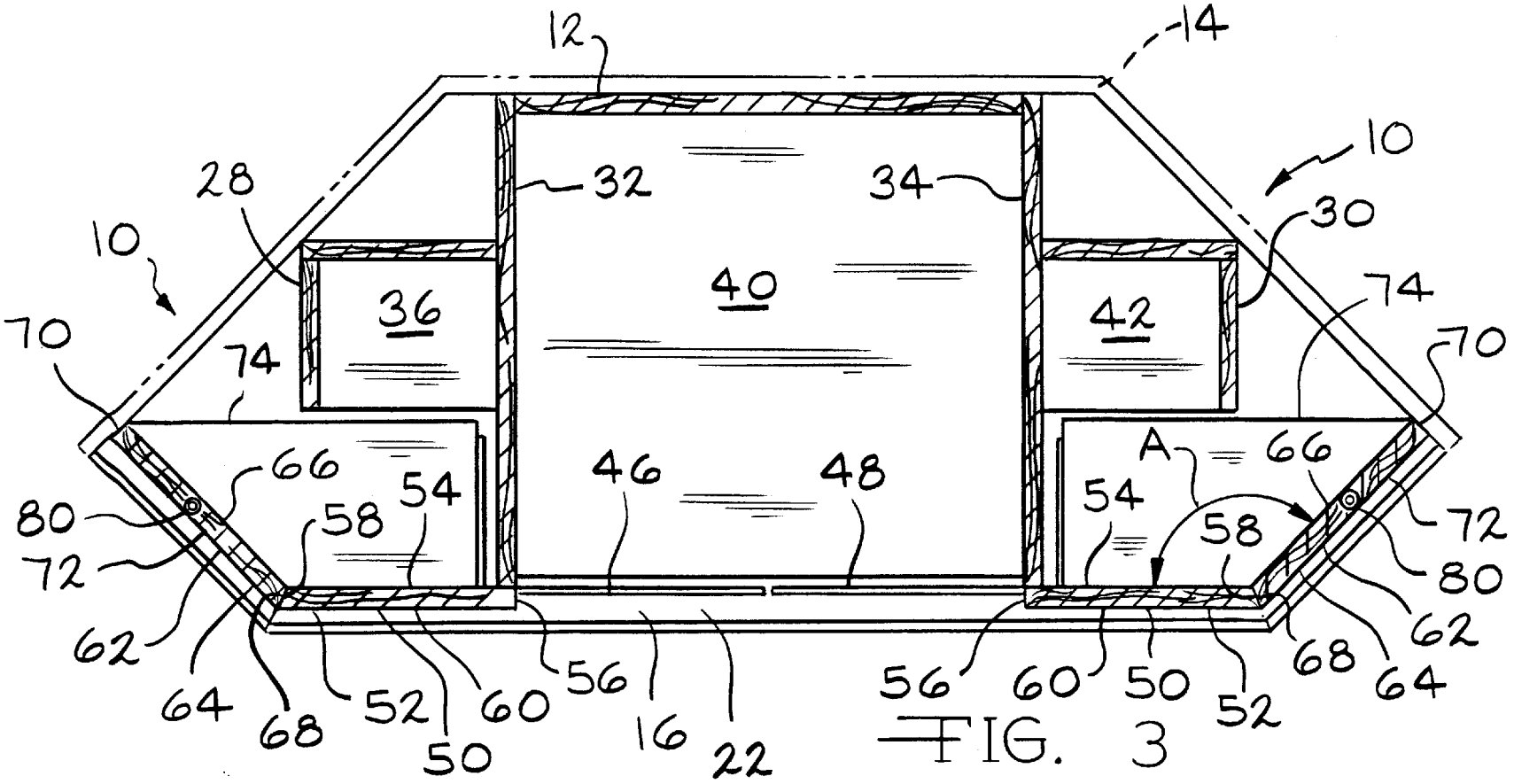
FIG. 3 is a plan view of the cabinet shown in FIG. 1 with the door assembly in a closed position.

Still referring to FIGS. 1–4, two door assemblies 10 are incorporated into the corner cabinet 12. Each of the door assemblies 10 includes a first door member 50 extending between the lower surface 20 of the top 14 and the upper surface 22 of the base 16. The first door 50 includes an exterior surface 52 and an interior surface 54. The first door 50 includes a first edge portion 56, a second edge portion 58 and a center portion 60 positioned between the first and second edge portions 56 and 58. Each door assembly 10 further includes a second door member 62 extending between the lower surface 20 of the top 14 and the upper surface 22 of the base 16. The second door member 62 includes an exterior surface 64 and an interior surface 66. The second door member 62 has a first edge portion 68, a second edge portion 70 and a center portion 72 positioned between the first and second edge portions 68 and 70. As shown in FIG. 3, the first edge portion 68 of the second door member 62 is attached or joined to the second edge portion 58 of the first door member 50 at a predetermined angle A that is greater than 90°. In a preferred embodiment, the predetermined angle A is about 135°. However, it should be understood that the predetermined angle A can vary depending on the application. Referring to FIG. 2, each door assembly 10 includes a first shelf 74 and a second shelf 76 that extend along the interior surfaces 54 and 66 of the first and second door members 50 and 62, respectively.

Figure 4:
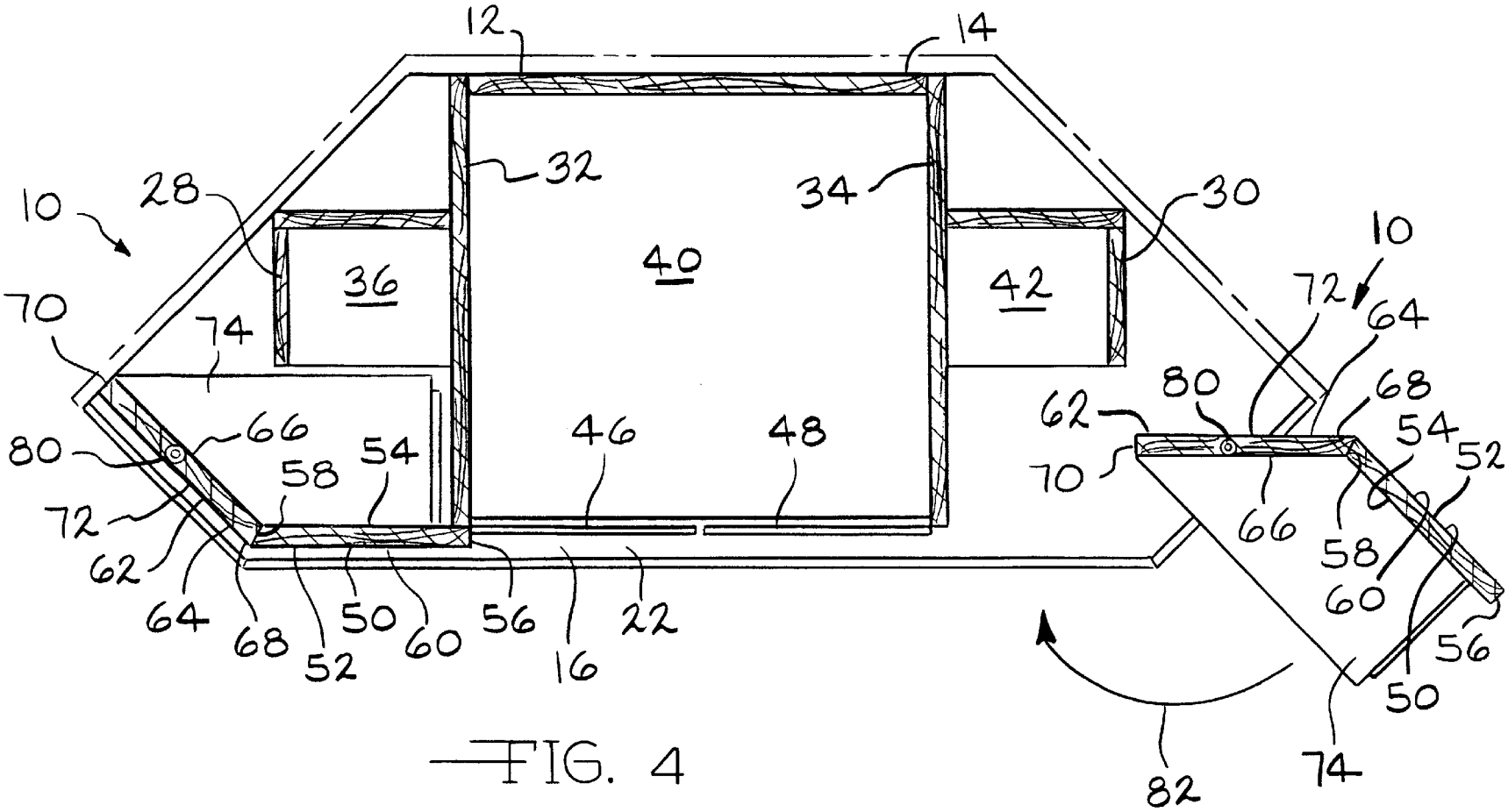
FIG. 4 is a plan view of the cabinet shown in FIG. 1 with the door assembly in an open position.

Referring to FIGS. 3 and 4, each door assembly 10 includes a top pivot hinge 80 connected to the center portion 72 of the second door member 62 and the lower surface 20 of the top 14. The assembly 10 further includes a bottom pivot hinge, which is a mirror image of the top hinge 80, that is connected to the center portion 72 of the second door member 62 and the upper surface 22 of the base 16. These hinges allow for pivotal movement of the first and second door members 50 and 62 between a closed position as shown in FIG. 3 and an open position as shown in FIG. 4. Accordingly, the first and second door members 50 and 62 are free to move in the direction indicated by an arrow 82 as shown in FIG. 4. When the first and second door members 50 and 62 are in the closed position as shown in FIG. 3, the first and second shelves 74 and 76 are positioned adjacent the cabinet shelves 36, 38, 42 and 44, respectively. When the first and second door members 50 and 62 are moved to the open position as shown in FIG. 4, access is provided to the first and second shelves 74 and 76 and the cabinet shelves 36, 38, 42 and 44. The arrangement of these shelves according to the present invention provides for the maximization of storage space within the cabinet 12.

Figure 5:
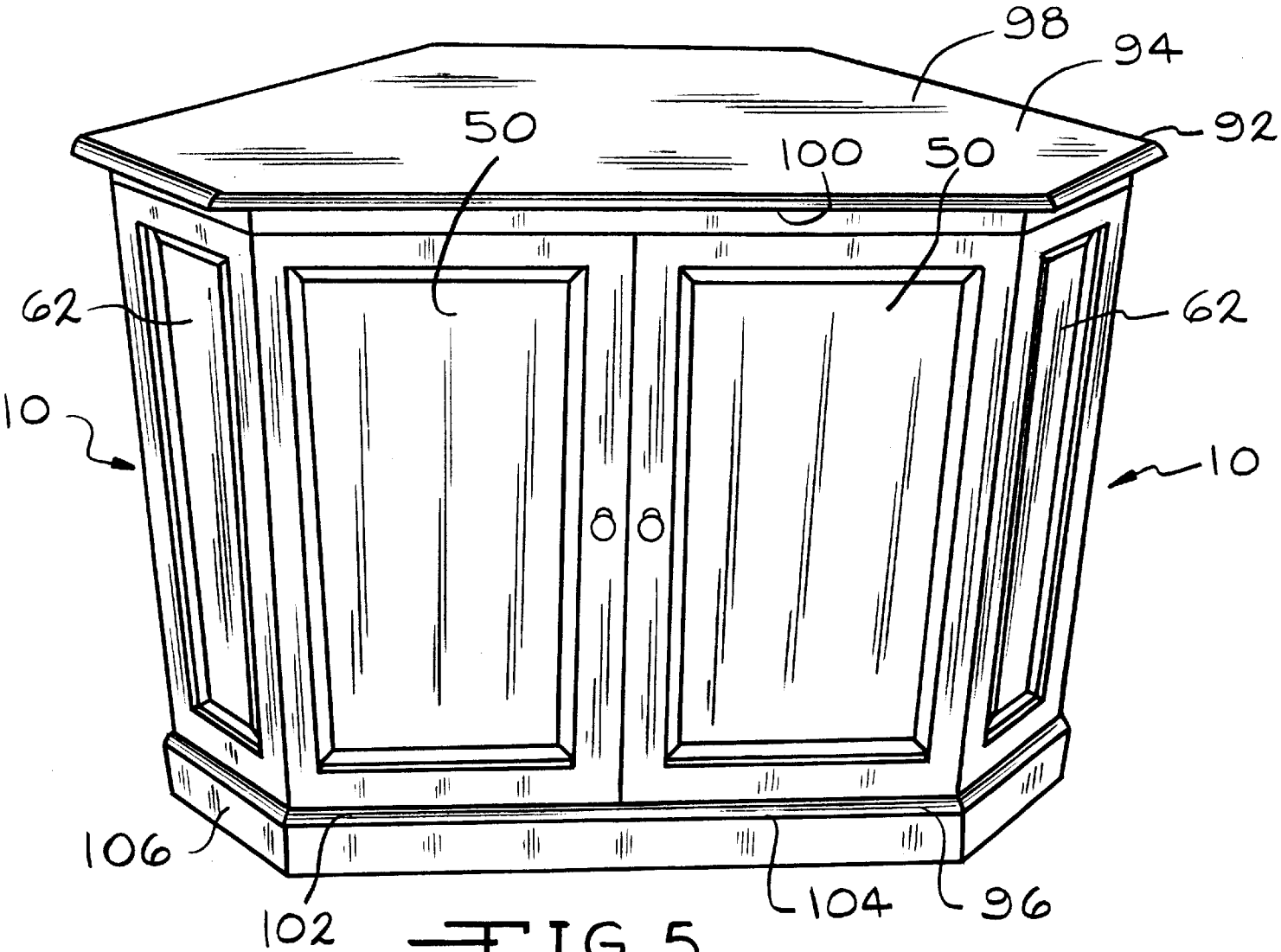
FIG. 5 is a front perspective view of a corner cabinet including a second embodiment door assembly according to the present invention.
Figure 6:
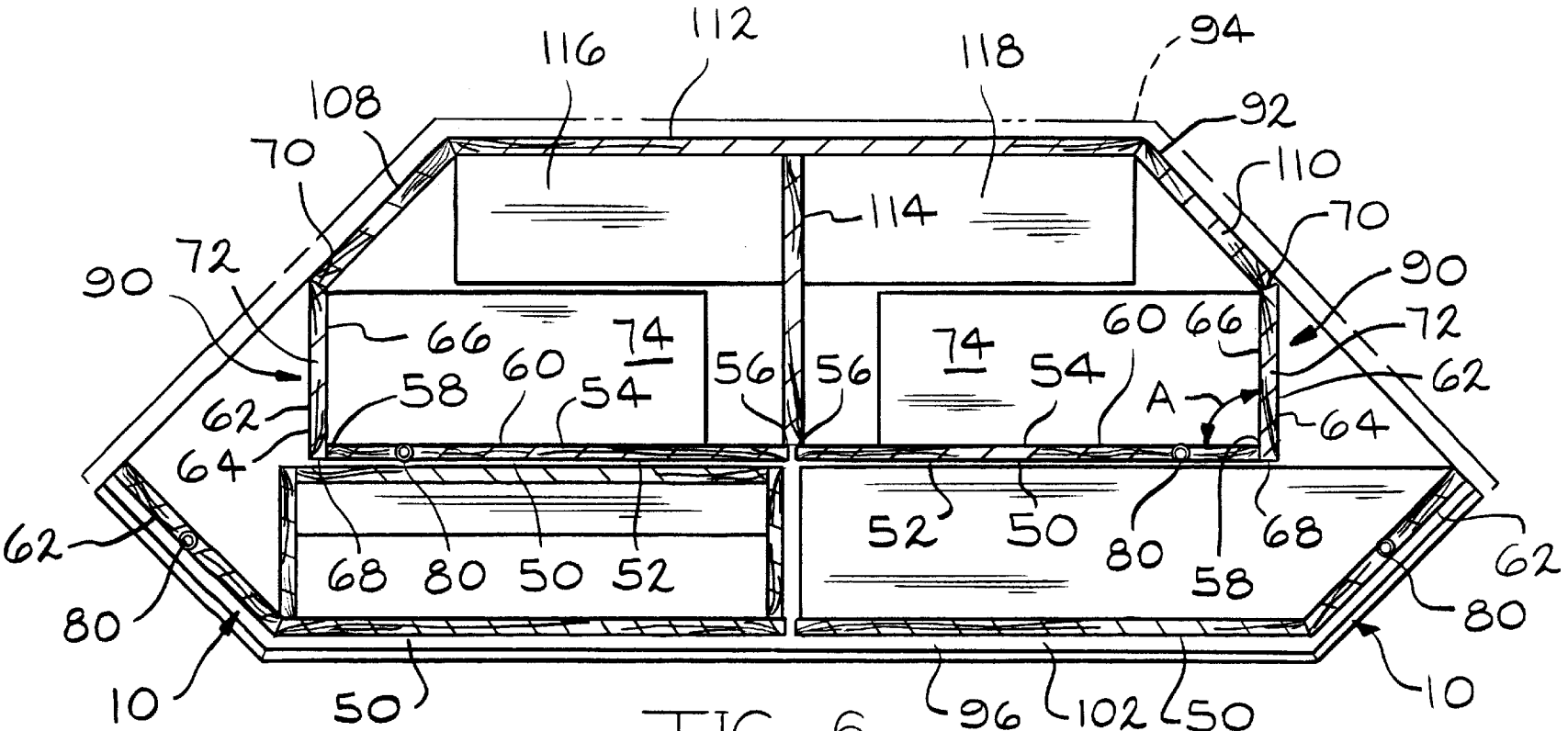
FIG. 6 is a plan view of the cabinet shown in FIG. 5 with the door assembly shown in a closed position.
Figure 7:
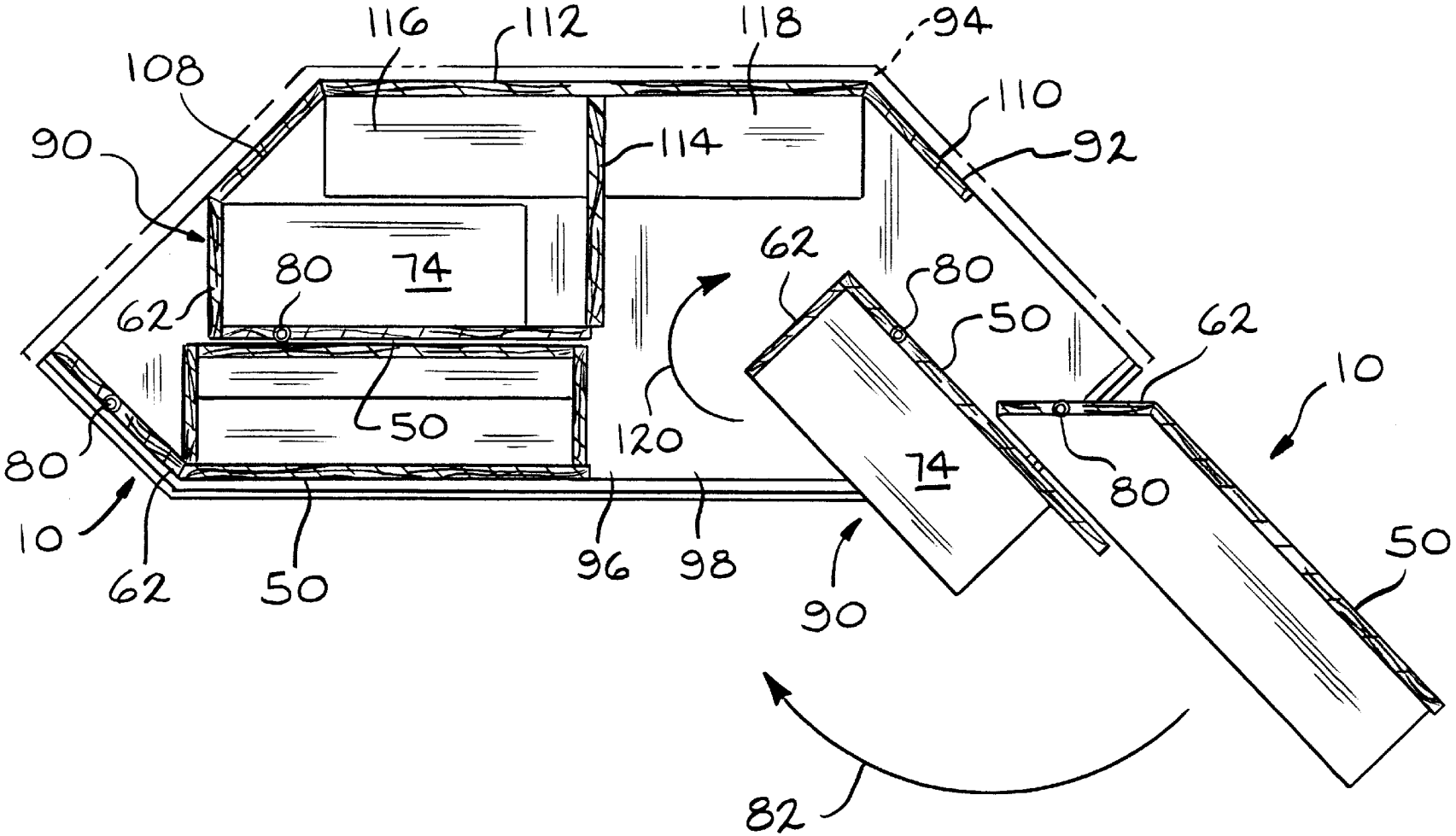
FIG. 7 is a plan view of the cabinet shown in FIG. 5 with the door assembly shown in an open position.

Referring to FIGS. 5–7, a second embodiment door assembly 90 is shown. The door assembly 90 is included in a corner cabinet 92 having a top 94 and a base 96. The top 94 includes an upper surface 98 and a lower surface 100. The base 96 includes an upper surface 102 and a lower surface 104. A skirt 106 is positioned adjacent the lower surface 104 of the base 96. As shown in FIGS. 6 and 7, the cabinet 92 includes a first side wall 108 and a second side wall 110. A back wall 112 extends between the first and second side walls 108 and 110. A center wall 114 extends outwardly from the back wall 112. At least one shelf 116 extends between the first side wall 108 and the center wall 114 adjacent the back wall 112. At least one shelf 118 extends between the second side wall 110 and the center wall 114 adjacent the back wall 112.

Referring to FIGS. 5–7, the cabinet 92 incorporates two door assemblies 10 as described above. Two second embodiment door assemblies 90 are positioned between the door assemblies 10 and the first and second side walls 108 and 110.

As shown in FIGS. 6 and 7, each of the door assemblies 90 includes the same elements as described above for the first embodiment assemblies 10. The primary differences between the second embodiment and the first embodiment are in the positioning of the first and second door members 50 and 62 with respect to one another and the positioning of the pivot hinges. As shown in FIG. 6, the first edge portion 68 of the second door member 62 is attached to the second edge portion 58 of the first door member 50 at a predetermined angle A that is about 90°. However, it should be understood that the predetermined angle A can vary depending on the application. Still referring to FIG. 6, the top pivot hinge 80 is connected to the center portion 60 of the first door member 50 and the lower surface 100 of the top 94. A bottom pivot hinge, which is a mirror image of the top pivot hinge, is connected to the center portion 60 of the first door member 50 and the upper surface 102 of the base 96. The top and bottom hinges allow for the pivotal movement of the second embodiment door assemblies 90 between a closed position as shown in FIG. 6 and an open position as shown in FIG. 7. This pivotal movement is represented by an arrow 120 as shown in FIG. 7. When the second embodiment door assemblies 90 are in the closed position, as shown in FIG. 6, the shelves 74 are positioned adjacent the cabinet shelves 116 and 118. It has been found that the second embodiment door assembly 90 provides a cabinet, such as cabinet 92, with superior storage space.

Figure 8:
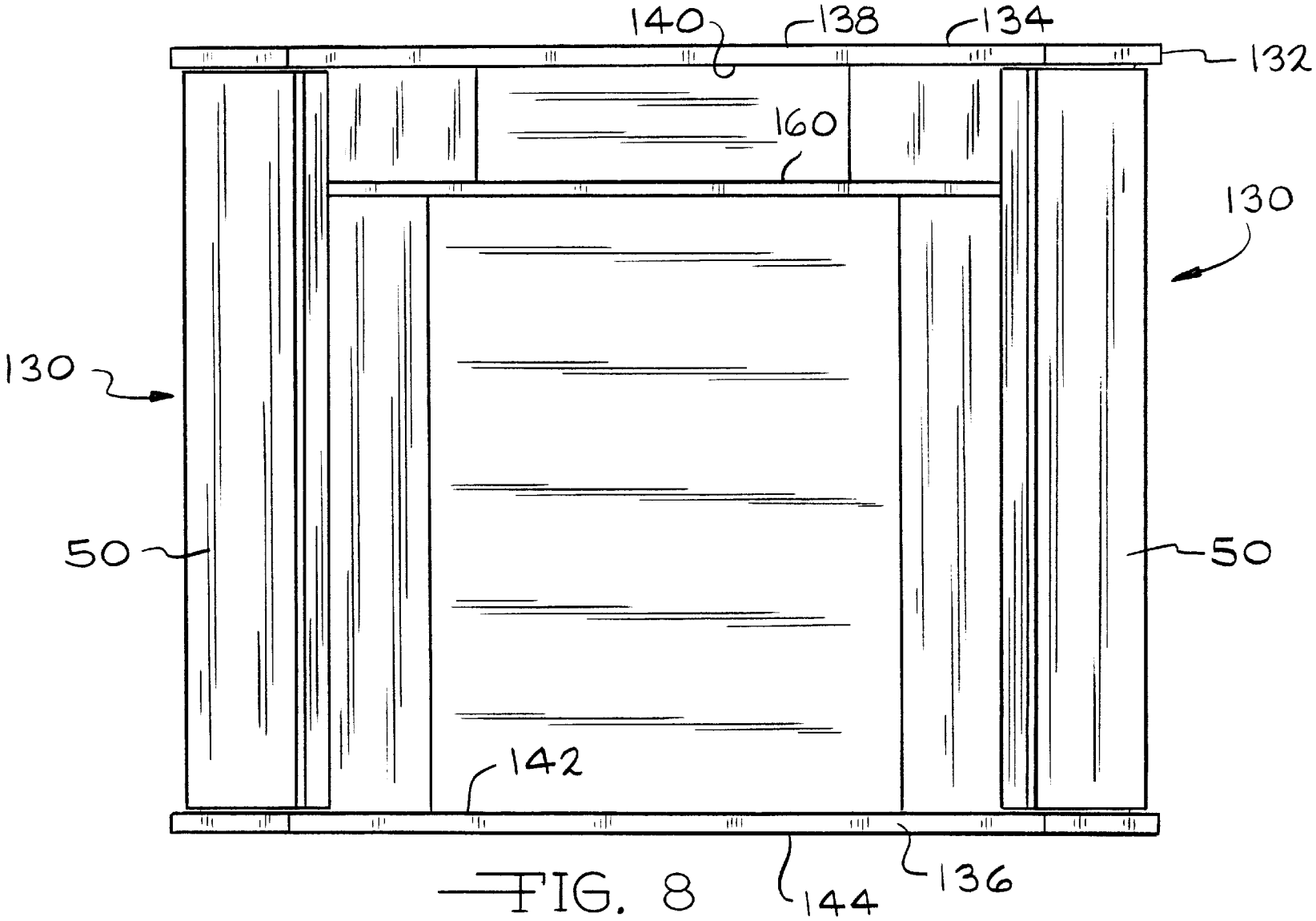
FIG. 8 is a corner cabinet including a third embodiment door assembly according to the present invention.
Figure 9:
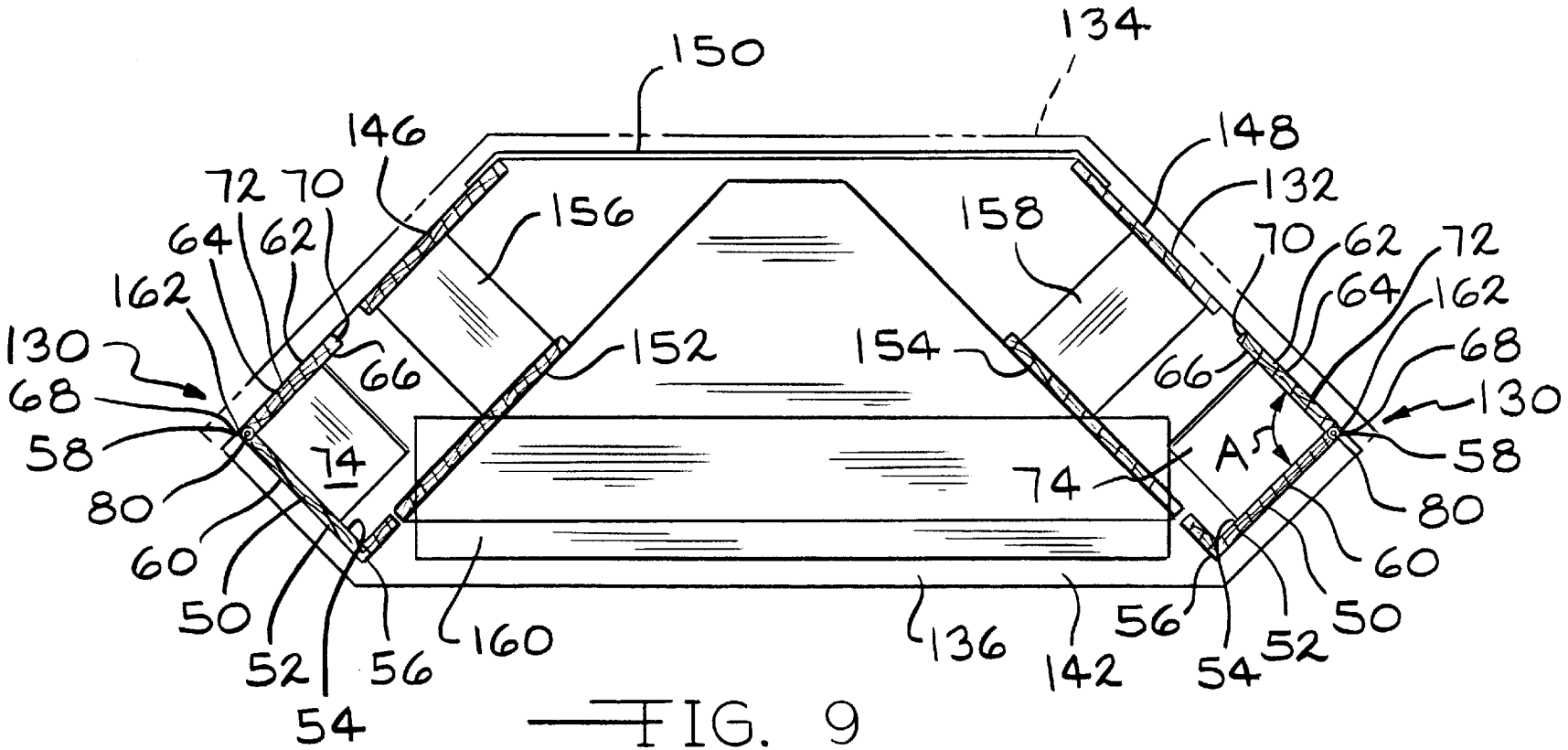
FIG. 9 is a plan view of the cabinet shown in FIG. 8 showing the door assembly in a closed position.
Figure 10:
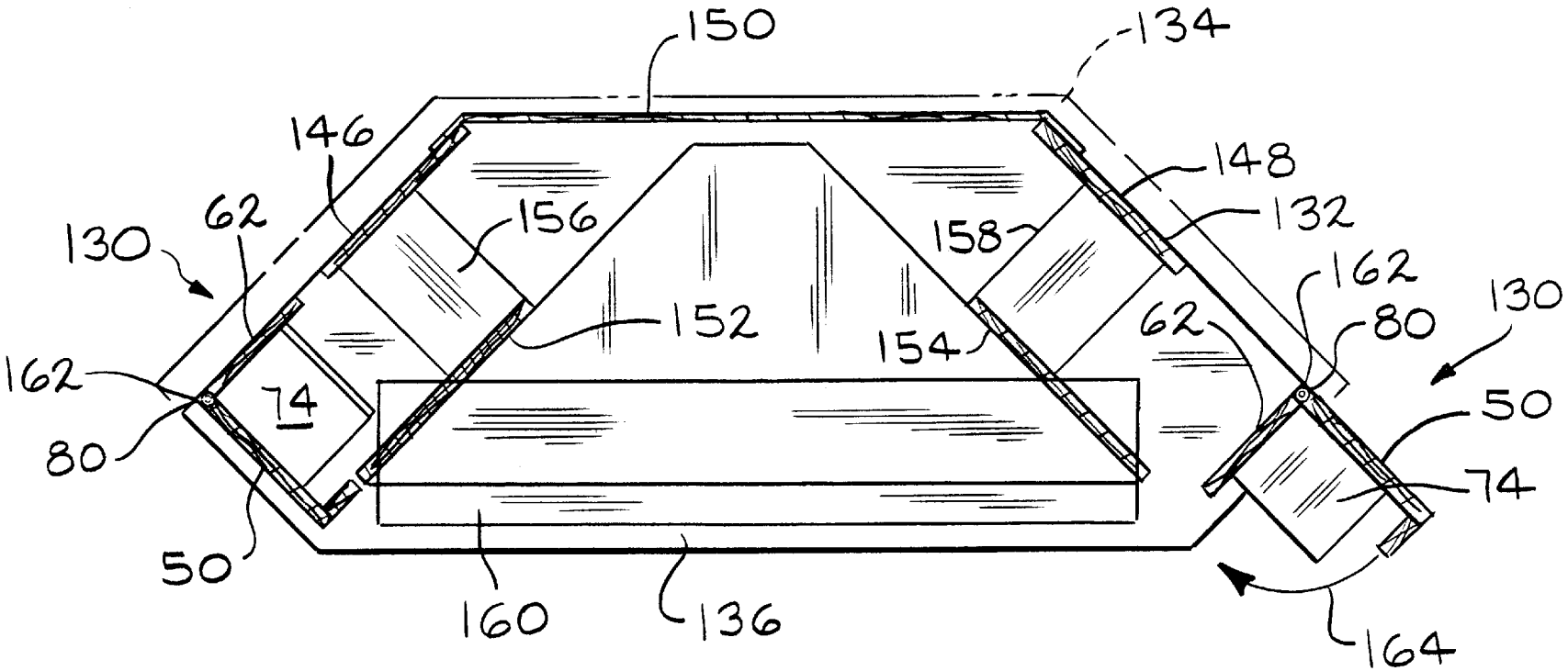
FIG. 10 is a plan view of the cabinet shown in FIG. 8 with the door assembly in an open position.

Referring to FIGS. 8–10, a third embodiment door assembly 130 is shown. A cabinet 132 incorporates two third embodiment door assemblies 130. The cabinet 132 includes a top 134 and a base 136. The top 134 includes an upper surface 138 and a lower surface 140. The base 136 includes an upper surface 142 and a lower surface 144. The cabinet 132 further includes a first side wall 146 and a second side wall 148. A back wall 150 extends between the first and second side walls 146 and 148. The cabinet 132 includes a first compartment wall 152 and a second compartment wall 154. A first shelf 156 extends between the first side wall 146 and the first compartment wall 152. A second shelf 158 extends between the second side wall 148 and the second compartment wall 154. A storage compartment 160 extends between the first and second compartment walls 152 and 154 adjacent the lower surface 140 of the top 134.

Still referring to FIGS. 8–10, each of the third embodiment door assemblies 130 includes the same features as described above for the first embodiment door assembly 10. The primary differences are found in the attachment of the first and second door members 50 and 62 to one another and the positioning of the pivot hinges. As shown in FIG. 9, the first edge portion 68 of the second door member 62 is attached to the second edge portion 58 of the first door member 50 at a predetermined angle A that is about 90°. This attachment forms a joint 162. It should be understood that the predetermined angle A can vary depending on the application. A top pivot hinge 80 is connected to the joint 162 and the lower surface 140 of the top 134. A bottom pivot hinge, which is a mirror image of the top pivot hinge, extends between the joint 162 and the upper surface 142 of the base 136. The top and bottom pivot hinges allow for the pivotal movement of the first and second door members 50 and 62 from a closed position as shown in FIG. 9 to an open position as shown in FIG. 10. This pivotal movement is represented by the arrow 164 as shown in FIG. 10. When the first and second door members 50 and 62 are in the closed position, as shown in FIG. 9, the shelves 74 are positioned adjacent the cabinet shelves 156 and 158. It has been found that the third embodiment door assemblies 130 provide a maximum of storage space for the cabinet 132.

The above detailed description of the present invention is given for explanatory purposes. It will be apparent to those skilled in the art that numerous changes and modifications can be made without departing from the scope of the invention. Accordingly, the whole of the foregoing description is to be construed in an illustrative and not a limitative sense, the scope of the invention being defined solely by the appended claims.

I claim:

1. A cabinet assembly comprising:

a top;

a base spaced from said top;

a back wall extending between said top and said base;

at least one shelf extending along said back wall;

a first door assembly, a second door assembly, a third door assembly positioned between said first door assembly and said back wall and a fourth door assembly positioned between said second door assembly and said back wall, each of said first, second, third and fourth door assemblies including a first door member extending between said top and said base, a second door member extending between said top and said base, and said first door member being attached to said second door member at a predetermined angle, at least one shelf extending between said first and second door members and hinge means connected to said top and said base to allow for pivotal movement of said first, second, third and fourth door assemblies between closed and open positions.

2. The assembly of claim 1, wherein said predetermined angle is about 90° or greater.

* * * * *

UNITED STATES PATENT AND TRADEMARK OFFICE

CERTIFICATE OF CORRECTION

PATENT NO. : 6,033,046
DATED : March 7, 2000
INVENTOR(S) : Michael D. Lambright

It is certified that error appears in the above-identified patent and that said Letters Patent is hereby corrected as shown below:

In col. 2, line 2, delete "do a" and insert --door assembly--.

Signed and Sealed this

Twenty-fourth Day of April, 2001

*Attest:*

Nicholas P. Godici

NICHOLAS P. GODICI

*Attesting Officer*

*Acting Director of the United States Patent and Trademark Office*